United States Patent [19]

Kniepkamp et al.

[11] 4,183,277

[45] Jan. 15, 1980

[54] RHYTHM ACCENT CIRCUIT

[75] Inventors: Alberto H. Kniepkamp, Arlington Heights; William Wangard, Melrose Park, both of Ill.

[73] Assignee: Norlin Industries, Inc., Lincolnwood, Ill.

[21] Appl. No.: 824,089

[22] Filed: Aug. 12, 1977

[51] Int. Cl.[2] ..... G10H 1/00; G10H 5/00

[52] U.S. Cl. ..... 84/1.03; 84/DIG. 12; 84/DIG. 23

[58] Field of Search ..... 84/1.01, 1.03, 1.17, 84/1.24, DIG. 12, DIG. 22, DIG. 23

[56] References Cited

U.S. PATENT DOCUMENTS

| | | | |
|---|---|---|---|
| 3,637,914 | 1/1972 | Hiyama | 84/1.03 |
| 3,649,736 | 3/1972 | Van Der Kooij | 84/1.03 |
| 3,916,750 | 11/1975 | Uetrecht | 84/1.01 |
| 4,014,167 | 3/1977 | Hasegawa et al. | 84/1.03 X |
| 4,031,786 | 6/1977 | Kaplan | 84/1.03 |

*Primary Examiner*—S. J. Witkowski

*Attorney, Agent, or Firm*—Ronald J. Kransdorf; Jack Kail

[57] ABSTRACT

In an electronic musical instrument of the type in which pitch selection is achieved by pulse position modulation, and a rhythm accompaniment is played automatically under the direction of a read-only memory, a shift register is used to create pulse position modulation instructions for harmonic footages of the fundamental note, and selected combinations of these footages are rhythm-modulated and rhythm-counter-modulated under the control of logic gates which are responsive to various manually operated stop tabs.

9 Claims, 3 Drawing Figures

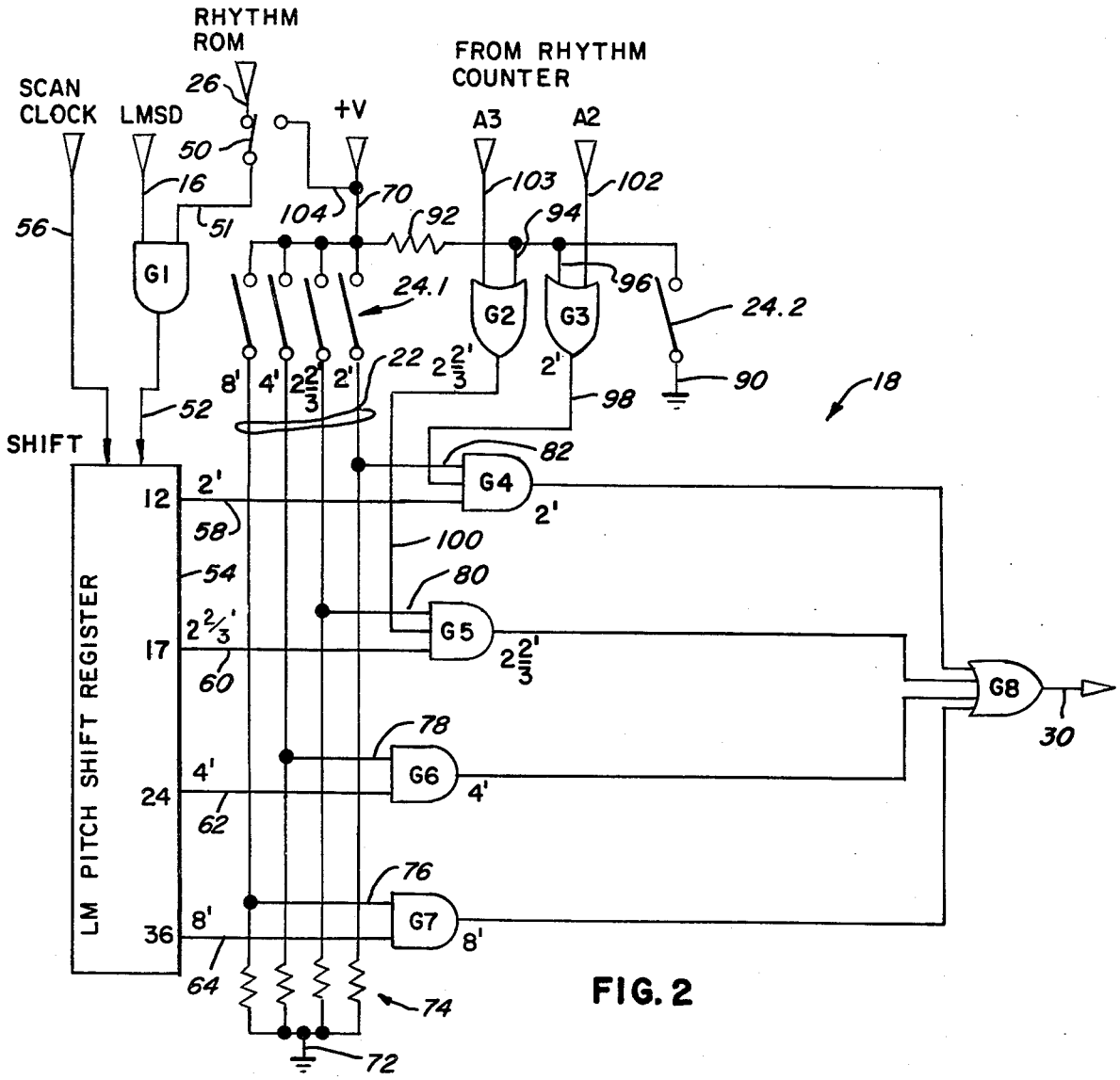
FIG. 2
FIG. 3
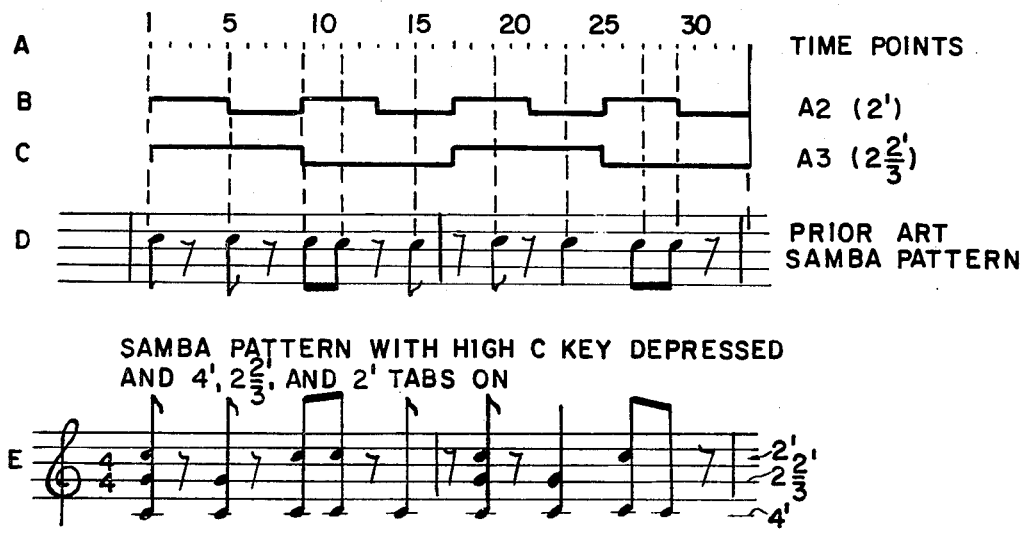

RHYTHM ACCENT CIRCUIT

BACKGROUND

1. Field of the Invention

This invention relates to electronic musical instruments, and particularly to electronic organs of the type that feature automatic playing aids for the non-expert musician, such as automatic rhythm accompaniment.

2. The Prior Art

Electronic organs are now on the market with various automatic features which permit a player of less than expert skill to accomplish certain musical effects which would otherwise require years of training and practice. An example is automatic rhythm accompaniment. With this feature, the inexpert player can concentrate on producing the melody, while the instrument itself will automatically provide a rhythm accompaniment. Some of the instruments that are on the market employ digital techniques for generating and/or selecting musical notes, including the notes for the automatic rhythm accompaniment feature. In particular, these instruments employ read-only memories with various rhythm patterns stored therein to generate a repetitive accompaniment. These repetitive patterns, however, can easily seem artificial or "machine-made" after just a few repetitions, because they are lacking in richness and variety of pitch.

Often the particular digital technique used for pitch selection is pulse position modulation. In this method of pitch selection, the various keyboards and manuals, both upper and lower, are repeatedly scanned electronically from the higher to the lower pitches. For each key which is found to be depressed during a scan cycle, a pulse is generated at the appropriate time position in the scan. Thus, the occurrence of a pulse early in the scan cycle represents a relatively high pitch selection instruction, whereas the occurrence of such a pulse later on in the scan cycle represents a lower pitch instruction.

So far as is known, prior art musical instruments have neither recognized the desirability of, nor developed appropriate techniques for, the introduction of pitch multiplicity into the production of automatic accompaniment rhythm patterns. Prior art electronic musical instruments with automatic accompaniment generation capability have always produced a constant pitch register accompaniment. The resulting bass accompaniments have been characterized by a low order of musical interest, and they tend to sound somewhat artificial.

SUMMARY OF THE INVENTION

The present invention improves upon prior art automatic rhythm accompaniment circuits by introducing the concept of pitch multiplicity. That is, the automatic bass accompaniment of this instrument is capable of being sounded in a plurality of harmonically related pitches simultaneously, for one or more beats of each repetition of the rhythm pattern. In addition, selection of the particular combination of pitches, and their distribution as a function of the various beats of the rhythm pattern, are subject to the player's control through the use of stop tabs or other appropriate manually operated switching means. Thus, if the player is not expert enough to provide his rhythmic bass accompaniment, at least he has a variety of realistic sounding multiple pitch accompaniments from which to choose, and can vary these, (1) by selecting the pitches to be played and (2) by selecting the distribution of these pitches over time as a function of the beat pattern of the particular rhythm employed.

Stated in structural terms, the invention contemplates an electronic musical instrument which, in common with the prior art, has means for automatically generating at least one instruction signal in a predetermined repetitive rhythm pattern. In addition, the instrument has a plurality of conventional means, each of which is responsive to such instruction signals, for generating respective musical tones differing in pitch. Unlike prior art instruments, however, the present invention has manually operable controls for connecting a plurality of tone generating means to the instruction signals so that the instrument automatically produces, for each lower manual key depressed, one of more pluralities of pitches simultaneously upon one or more beats of the rhythm accompaniment.

DETAILED DESCRIPTION OF THE PREFERRED EMBODIMENT

A preferred embodiment of the invention will now be described with reference to the following drawings:

FIG. 2 is a logic diagram of the keyboard encoder of the instrument illustrated in FIG. 1, which embodies rhythm accent improvement feature of this invention.

Figure 1:
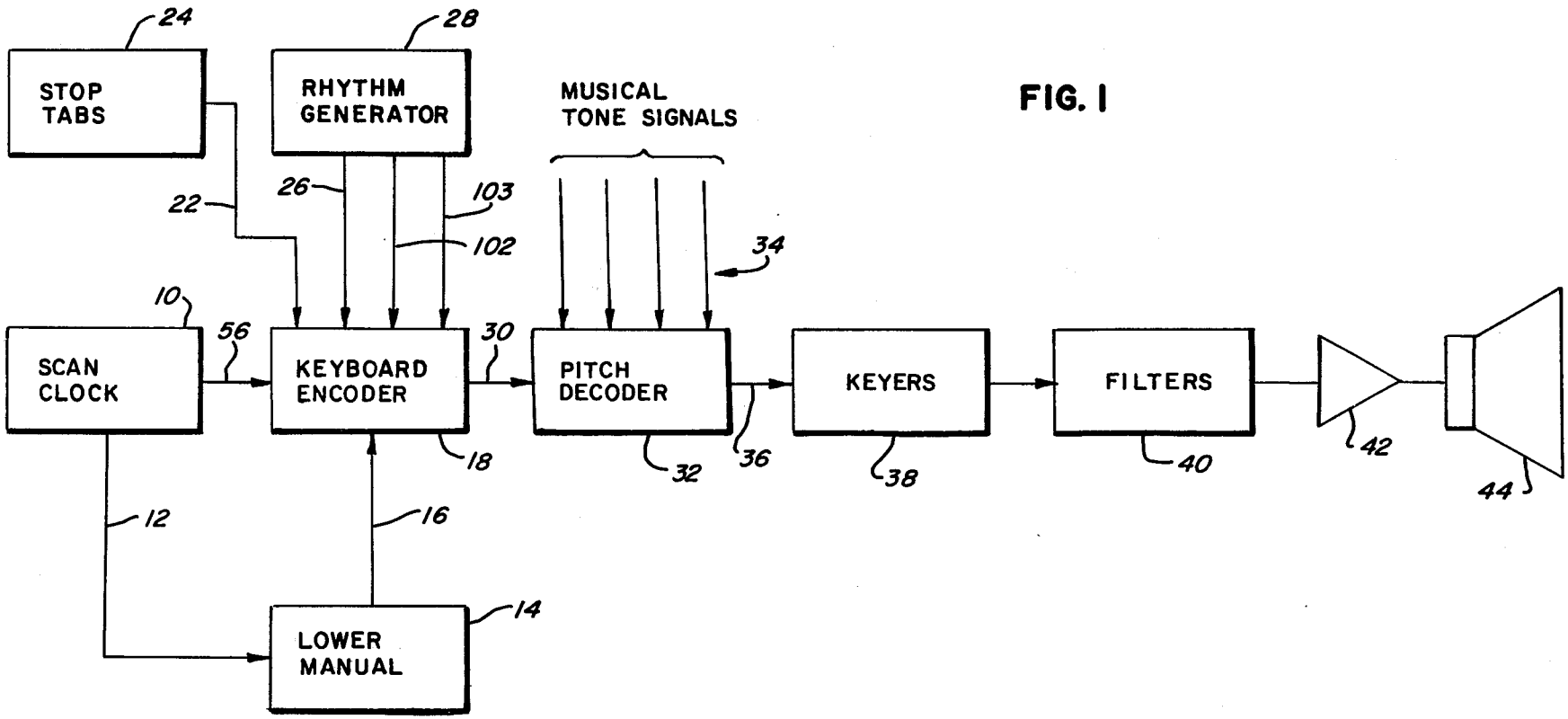
FIG. 1 is a functional block diagram of an electronic musical instrument, such as an organ, which employs a keyboard for note selection.

FIG. 3 is a timing diagram in which line A represents an arbitrary time scale, line B and C represent respective waveforms of two rhythm pattern instruction signals, line D represents a musical rhythm accompaniment played in a single pitch, such as might be done by a prior art instrument, and line E represents the same pattern played in a multiplicity of pitches and rhythms in accordance with this invention.

Referring now to FIG. 1, an electronic musical instrument of the keyboard type, e.g. an organ, is there illustrated in very general terms. Only those portions of the organ which are necessary in order to understand the production of the automatic bass accompaniment are included in FIG. 1, since those components which are devoted exclusively to the generation of melody and other treble notes are well understood in the art. Note that a scan clock 10 puts out over a line 12 a signal which scans a lower manual 14, which is the accompaniment keyboard of the instrument. As the scan clock 10 scans the manual 14 (from the highest pitch key to the lowest pitch key), the scan output appears in serial pulse form on a single line 16. Because of the descending direction of the scan, the resulting pitch selection information appears on line 16 in pulse position modulation code. That is, within each scan interval of the clock 10, a pulse appears on line 16 relatively early in the scan when it represents the depression of a relatively high pitch key in the lower manual 14, and conversely it appears later in the scan when it represents the depression of a lower pitch key in the manual 14. The pulses appearing on line 16 are known collectively as "serial data" pulses, one complete scan of the manual 14 being referred to as a serial data cycle.

The serial data, or pulse position modulated pitch selection information, on line 16 is delivered to a keyboard encoder 18. Another input to the same keyboard encoder is an automatic rhythm signal on a line 26 which is derived from an automatic rhythm generator circuit 28. The latter circuit is a conventional one, and may be of the type which is described in detail in U.S. Pat. No. 4,010,667 issued Mar. 8, 1977 to Alberto H. Kniepkamp. Simply stated, a rhythm generator 28 of that type is controlled by a pattern stored in a read-only memory. It converts that pattern into a repetitive series of rhythm beat signals, which are used to gate the pulse position code signals arriving from the lower manual 14.

The keyboard encoder converts the signals received by it on lines 16 and 26 into a repetitively rhythm-gated pitch instruction signal that is delivered on an output line 30 to a decoder circuit 32 which performs the function of musical pitch selection. The pitch decoder 32 receives a plurality of musical tone signals on several lines 34, a small representative number of which are indicated in FIG. 1. The musical tone signals on the lines 34 are voltages of suitable wave-form which vary at audio frequencies corresponding to the musical pitches to be played by the instrument. The decoder 32 responds to each pulse position modulated instruction signal on line 30 by choosing a particular one of the tone signals on line 34, thus selecting the musical pitch to be played by the instrument. The tone signal on the selected line 34 goes out over a line 36 to various audio circuits including keyers 38, filters 40 and an amplifier 42, which drives an audio transducer such as a speaker 44 to produce a sound output at an acoustical frequency equal to the frequency of the tone signal on the selected line 34.

The plurality of tone signals available on lines 34 may be derived from any conventional source common in the electronic musical instrument art. The most usual expedient for generating a plurality of musical tone signals at different audio frequencies is to provide one or more master oscillators operating at relatively high frequency of frequencies, the output or outputs of which are divided down in frequency by one or more chains of divider circuits. Then the outputs of the various frequency division stages, which represent a plurality of musical tone signals at different audio frequencies, are applied to the various decoder input lines 34. As so far described, the circuitry of the musical instrument of FIG. 1 is entirely conventional.

We turn next to the logic diagram of FIG. 2, which shows the details of the keyboard encoder 18, which embodies the improvement in accordance with this invention. There it is seen that the read-only memory output on line 26 from the rhythm generator 28 passes through an automatic rhythm selection switch 50 and over a line 51 to an AND gate G1. The only other input to the AND gate, beside line 51, is the lower manual serial data signal on line 16. When the automatic rhythm selection switch 50 is in its illustrated position, gate G1 is enabled whenever the ROM-controlled automatic rhythm pattern has a beat, represented by a pulse delivered over lines 26 and 51 to gate G1. The duration of each ROM rhythm beat pulse is at least equal to one full lower manual scan cycle, so that any lower manual serial data pulse on line 16, representing a key depression in the lower manual 14, can coincide with a gate—enabling pulse on line 26 whenever the ROM rhythm pattern has a beat. When such coincidence occurs, the serial data pulses, one for each lower manual key depression, come through the gate G1 in serial fashion.

Each of these gate output pulses is then applied over a line 52 as the first stage input to a lower manual pitch shift register 54, which has a length, in this illustrative example, of at least thirty-six stages. An output is taken from the scan clock 10 over a line 56 (see also FIG. 1), and applied to the clock (shift) input of shift register 54. As a result, each serial data pulse arriving at stage one of the register 54 is subsequently shifted through each of the thirty-six or more stages of the register successively, at scan clock frequency. Each serial data pulse from gate G1 subsequently appears on a line 58 twelve scan clock times later, and on a line 60 seventeen scan clock times later, and on a line 62 twenty-four scan clock times later, and on a line 64 thirty-six scan clock times later, relative to the original input on line 52; this is because lines 58 through 64 are connected to the outputs from the 12th, 17th, 24th, and 36th stages respectively of the lower manual shift register 54.

Shift register 54 is in effect a tapped delay line. Because each of these outputs on lines 58 through 64 occurs at a successively later time than the preceding one, each output represents a successively lower pitch in the pulse position modulation code to which the pitch decoder 32 responds. Consequently, each single note serial data pulse on line 52 is converted into a plurality of serial data pulses on lines 58 through 64 representing respectively four different notes. Moreover, the choice of particular stages of the shift register 54, stages twelve, seventeen, twenty-four, and thirty-six, is so calculated, in terms of the note-determining pulse position modulation code, that the pulse on line 60 represents a musical note a fifth interval lower than the note represented by the pulse on line 58, the pulse on line 62 represents a note an octave lower than the note represented by the pulse on line 58, and the pulse on line 64 represents a note two octaves lower than the note represented by the pulse on line 58. Thus, as illustrated in FIG. 2, the outputs on lines 58 through 64 represent, in pulse position modulation code, two foot, two and two-thirds foot, four foot, and eight foot tone signals respectively, for each key depressed in the lower manual 14. In this way, a set of pulse position modulation instruction signals, representing four harmonically related musical tones, is derived from a single musical tone instruction.

These harmonically related musical tone instruction signals on line 58 through 64 are controlled by AND gates G4 through G7 respectively, the outputs of which are OR'ed together by a gate G8 and then passed out on the keyboard encoder output line 30. Consequently, the pulse position modulation code instruction signal for each of the four harmonically related musical tones is passed along on the line 30 to the pitch decoder, which can result in the entire set of four harmonically related musical tone signals being sounded for each lower manual key depression represented by a serial data pulse on line 16. If more than one lower manual key is depressed at any one time, then the serial data pulse on line 16 for each of the depressed keys is similarly split by means of the shift register 54 into a set of four harmonically related musical tone instruction signals, and sent on its way to the pitch decoder 32 whenever the logical conditions imposed by the AND gates G4 through G7 permit.

The function of the gates G4 through G7 is to determine which of the four harmonically related notes will be sounded at the proper times during the rhythm pattern. Each of these gates requires at least one enabling input, which comes from its respective one of a bank of manually operated stop tab switches 24.1, which are connected to the inputs of the respective AND gates G4 through G7 by respective lines 22 (see also FIG. 1).

Thus, one of the switches 24.1 which is labeled 8′ must be closed in order to enable gate G7 which controls the 8′ tone signal derived from pitch register 54. When that switch is closed, current flows from a positive supply voltage line 70 to ground point 72 through the 8′ stop tab switch tab 24.1 to ground and the associated one of the several resistors 74. The resulting positive voltage developed across the resistor 74 is applied over a line 76 to enable gate G7, thus permitting the 8′ tone instruction signal on line 64 to be passed along to the OR gate G8 and out over line 30. If, however, the 8′ stop tab switch 24.1 is left open, then no current flows through the associated resistor 74, and ground voltage is communicated from point 72 to the gate input line 76. This disables gate G7 and prevents the 8′ musical tone instruction signal from reaching OR gate G8 and output line 30. In similar fashion, the 4′ stop tab switch 24.1 and its associated resistor 74 determine whether or not an enabling voltage is applied to a lead 78 to enable gate G6, which controls the 4′ musical tone instruction signal; the $2\frac{2}{3}'$ foot stop tab switch 24.1 and its associated resistor 74 determine whether or nor an enabling voltage is applied over a line 80 to gate G5 which controls the $2\frac{2}{3}'$ musical tone instructional signal; and the 2′ stop tab switch 24.1 and its associated resistor 74 determine whether or not an enabling voltage is applied over a lead 82 to gate G4 which controls the 2′ musical tone instruction signal. Thus, by opening any of the four stop tab switches 24.1 labeled 8′, 4′, $2\frac{2}{3}'$ and 2′ respectively, the player can prevent the operation of one or more of the corresponding footages relative to each lower manual note selected by key depression in the lower manual 14. Conversely, by closing any of the appropriate stop tab switches 24.1 the player can enable (or at least condition) the playing of one or more of the corresponding footages for each of these notes.

Gates G6 and G7 controlling the 4′ and 8′ subharmonics respectively require no additional enabling inputs, other than those supplied by the corresponding 8′ and 4′ stop tab switches in the group 24.1. As a result, these footages are played every time the rhythm pattern produced by the read-only memory of the rhythm generator 28 has a beat (i.e. produces a pulse on input line 26). In contrast to this, the 2′ and $2\frac{2}{3}'$ gates G4 and G5 each require an additional input from OR gates G3 and G2 respectively in order to be enabled. Thus, additional logical conditions are required to be satisfied to permit the playing of these two footages.

One way in which the additional enabling inputs to the gates G4 and G5 can be supplied is by opening a stop tab switch 24.2, which prevents ground point 90 from drawing current through a resistor 92 from the positive voltage line 70. If there is no current then there is no voltage drop across the resistor 92, and the positive voltage on line 70 is communicated over lines 94 and 96 to gates G2 and G3 respectively, which are then permitted to supply the additional enabling inputs over lines 98 and 100 rquired by gates G4 and G5 respectively. Under these conditions, the outputs of OR gates G2 and G3 will always be up, and consequently gates G4 and G5 will always be in condition to be fully enabled by their associated stop tab switches 24.1. Therefore, in this operating made, depending on the settings of switches 24.1, the operation of gates G4 and G5 and the sounding of the 2′ and $2\frac{2}{3}'$ tones will be operated exclusively by the ROM rhythmic pattern on line 26, just as are the gates G6 and G7 and their corresponding musical tones, 4′ and 8′ respectively.

On the other hand, this operating mode can be defeated by closing the manual stop tab switch 24.2, so that ground point 90 draws current through resistor 92 from positive voltage line 70. Under these conditions the resulting voltage drop across resistor 92 causes the OR gate input lines 94 and 96 to go low, which prevents the OR gates G2 and G3 from conditioning the AND gates G4 and G5. When that happens, the only way that the OR gates can condition the AND gates is by means of rhythm counter inputs A2 and A3 arriving on lines 102 and 103 respectively from the rhythm generator 28 (see FIG. 1). These input voltages, as seen in FIGS. 3B and 3C, consist of square waves at different frequencies, which in this illustrative embodiment have a 2:1 ratio. These square waves are derived from conventional counter circuits, known as rhythm counters, which are included, along with the read-only memory, in the rhythm generator circuit 28. While the rhythm generator 28 produces on line 26 a musically identifiable dance rhythm, e.g. a samba, stored in the read-only memory, it also produces on lines 102 and 103 a repetitive square wave pattern at two different frequencies. The rhythm counter inputs A2 and A3 on lines 102 and 103 each have a pulse duration greater than one lower manual scan cycle time, so as to insure coincidence at the AND gates G4 and G5 with the 2′ and $2\frac{2}{3}'$ serial data pulses on lines 58 and 60. As a result, when switch 24.2 is closed, gate G4 is enabled, to sound the 2′ tone corresponding to each keyboard-selected note, when and only when a dance rhythm beat occurs during a high portion of the A2 square wave seen in FIG. 3B; and similarly the gate G5 is enabled, to sound a $2\frac{2}{3}'$ tone for each key depression, when and only when a dance rhythm beat occurs during a high portion of the lower frequency square wave A3 seen in FIG. 3C.

Thus, when stop tab switch 24.2 is closed, the 2′ and $2\frac{2}{3}'$ tones for each lower manual note played are sounded during some, but not all, beats of the ROM dance rhythm; whereas the 4′ and 8′ tones for each lower manual note played can be sounded on all the beats of that dance rhythm depending on the footage selection tab switches 24.1. On the other hand, as previously described, when manual stop tab switch 24.2 is open, then all four of the footages can be sounded on all beats of the dance rhythm derived from the ROM, again depending on which of the footage selection tab switches 24.1 are closed. As described above, any one or more of these footages can be deleted completely, i.e. not sounded at all on any of the dance rhythm beats, by opening the corresponding stop tab switches 24.1.

Finally, still another measure of manual control over the operation of the circuit is achieved by manually moving the automatic rhythm switch 50. As described above, when that switch is in its illustrated position, the enabling input on line 51 for the gate G1 can only be derived from the ROM rhythm pattern pulses appearing on line 26. On the other hand, if switch 50 is transferred to a line 104, then a positive enabling voltage for gate G1 is continuously available on line 51. As a result gate G1 is continuously enabled, so that all the lower manual serial data pulses on line 16, corresponding to one or more depressed keys in the lower manual, are passed through the gate G1 to sound one or more notes during the entire time that such key or keys remain depressed, and not merely on the beats of the ROM dance rhythm. In other words, the sounding of the keyed notes would then be determined exclusively by the manual depression and release of the lower manual keys by the left hand of the musician in some non-automatic rhythmic pattern, rather than depending upon the automatically generated rhythm pattern derived from the read-only memory of circuit 28.

Even in this mode, however, the selection of the four available footages to accompany each bass note is subject to the setting of stop tab switches 24.1. In addition, the sounding of the 2′ and 2⅔′ tones would occur only in accordance with the square wave patterns of the A2 and A3 voltages respectively, if stop tab switch 24.2 is closed. If the operation of the accompaniment is to be completely manual, not only must the rhythm selector switch 50 be transferred to lead 104, but stop tab switch 24.2 must be closed so that gates G2 and G3 are permitted to keep gates G5 and G4 continuously enabled.

The advantage of being able to sound any given rhythm pattern in multiple pitches is seen by comparing FIGS. 3D and 3E. FIG. 3D shows a samba rhythm pattern as it might be played, by a prior art instrument, on a single note, in this example, high C. By comparison, for the same single lower manual key depression, many harmonically related footages are sounded in the same samba rhythm in FIG. 3E, which represents the output of a musical instrument in accordance with this invention. These multiple pitches, produce a much fuller and more pleasing accompaniment.

Note in FIG. 3E that the various footages are not all sounded strictly in accordance with the basic samba rhythm pattern of FIG. 3D, since the footage tabs and the A2 and A3 waveforms in FIG. 3B and C also have an important influence in determining the ultimate distribution of pitches over time. Thus, in the specific example of FIG. 3E, the footage stop tabs are set so that only the 2′, 2⅔′ and 4′ switches 24.1 are closed. The 8′ switch is open. Hence, three footages (2′, 2⅔′, and 4′) are the only ones sounded at this time, and the fourth one, 8′, is silent throughout the entire interval represented by FIG. 3E. In addition, even the footages which are on are not all sounded on every beat of the samba pattern (i.e. every ROM pulse on line 26). The 4′ tone is sounded for every ROM rhythm beat, of course, because its gate G6 is not controlled by the rhythm counters inputs A2 or A3 (the same would be true of the 8′ tone and its gate G7, if this tone were enabled by its stop tab switch 24.1). But the 2′ and 2⅔′ tones, and their gates G4 and G5, are controlled by the rhythm counter inputs A2 and A3 respectively (whenever tab stop swtich 24.2 is open, as it is assumed to be in the example illustrated by FIG. 3E). Thus, assuming that only one lower manual key (C above middle C) is depressed at this time, the 4′ tone (middle C, one octave above the note represented by the lower manual key) is sounded on all samba beats, i.e. time points 1,5, 9–11, 15, 19, 23, and 27–29. The 8′ tone (C below middle C) is not sounded at all, because it is silenced by its stop tab switch 24.1. The 2′ tone (C above middle C) is sounded only when a samba beat coincides with a pulse on rhythm counter input A2, i.e. at time points 1, 9–11, 19 and 27–29, but not on the samba beats occurring at time points 5, 15, and 23, when voltage A2 is down. Similarly, the 2⅔′ tone (middle G) is sounded only when a samba beat coincides with a pulse on rhythm counter input A3, i.e. at time points 1, 5, 19 and 23, but not on the samba beats occurring at time points 9–11, 15, and 27–29 when voltage A3 is down. The same analysis can be applied for every other note corresponding to a key which is depressed in the lower manual 14. The variations imposed upon the 2′ and 2⅔′ tones for ech such note (independently of each other, and independently of the 4′ and 8′ tones also) add a pleasing variety to the automatic accompaniment, and result in a much less artificial or "machine-made" sound.

Until this point, for the sake of simplicity the invention has been described on the assumptions that every lower manual key depression produces only a single serial data pulse on line 16, and that the serial data pulses on line 16 for that key continue to appear on line 16 once each scan cycle only so long as the key remains depressed. In all probability, however, the invention is more likely to be used on a more sophisticated organ having two special automatic features which may invalidate those assumptions. The first of these features is produced by a special automatic chord function generator circuit, which plays, for example, an entire C-chord in the bass register whenever merely a single C-note key in the automatic chord region of the lower manual is depressed. The second feature is produced by an automatic chord-hold circuit, which prolongs the playing of a chord beyond the time when the key which initiated the chord is released, until the chord-hold circuit is turned off, or a new chord is selected. Both of these special automatic circuits are by now conventional, and form no part of the present inventions, so no disclosure thereof is appropriate. Indeed, they bear mention at this point merely for completeness, and in order to point out that in an important sense the present invention functions in exactly the same manner whether or not these special feature circuits are operating. So far as is relevant here, the only effect of these special circuits is to produce additional serial data pulses on line 16; i.e. the effect of the chord function generator circuit is to produce a plurality of additional serial data pulses (within one scan cycle) representing the additional notes of the chord, instead of only one serial data pulse representing a single note corresponding to the one chord-initiating key which is depressed; and the effect of the chord-hold circuit is to continue the production of these serial data pulses (in each subsequent scan cycle) for some time after the initiating key depression is discontinued. The important point to note is that the automatic rhythm accent circuit of this invention treats each serial data pulse on line 16 alike, whether it is manually or automatically generated. Whether it directly represents an actual key depression or is artificially generated to produce extra chord notes, and whether it occurs during an actual key depression or an artificial prolongation thereof, each serial data pulse on line 16 is split, by the circuit described herein, into four footage instruction signals, and thus can be played in that many harmonically related pitches, which are dance-rhythm-gate and/or counter-gated, all depending on the manual setting of the tabs.

It will now be appreciated that not only does the present invention provide an automatic rhythm accompaniment which is sounded in a multiple set of harmonically related footages for each accompaniment note played, but in addition the various footages can be sounded in different combinations by manually adding or deleting them through the use of stop tabs. Furthermore some of them can be sounded solely under the control of an automatic dance rhythm generator, while others are further subject to the control of a repetitive square wave pattern which is superimposed on the dance rhythm. It will also be appreciated that the particular illustrative example discussed herein represents only one of many different ways to capture the concept of this invention in hardware form, and other physical embodiments, particularly those using some scheme other than pulse position code for pitch selection, may equally well employ this concept.

We claim:

1. In an electronic musical instrument having means for cyclically generating one or more serial data pulses, the position of each pulse in a serial data cycle being indicative of a particular tone pitch, means for generating an instruction signal comprising a predetermined pattern of beat signals, the duration of each of said beat signals being at least equal to one serial data cycle, and a plurality of tone signal means, each responsive to a predetermined serial data pulse for generating a musical tone having a selected pitch, the improvement comprising means operative in response to said beat signals for converting each serial data pulse into a plurality of serial pulses; and means, including manually operable controls, for selectively applying said plurality of serial pulses to cause outputs from corresponding ones of said tone signal means, whereby a selected plurality of tone signals are generated in response to each of said beat signals.

2. An instrument as claimed in claim 1 wherein the pulses generated by said converting means are serially positioned to cause tone signals to be produced which are octavely related to the tone signal produced in response to the converted serial data pulse.

3. An instrument as claimed in claim 1 wherein said converting means includes means responsive to each serial data pulse for producing pulses on a plurality of separate lines, the pulse on each of said lines corresponding to a tone pitch bearing a predetermined relationship to the tone pitch of the serial data pulse applied to the converting means; and wherein said means for selectively applying the serial pulses includes a gating means for each of said lines and manually operable controls selectively operable for at least partially enabling each of said gating means.

4. An instrument as claimed in claim 3 wherein said means for producing pulses on separate lines includes a shift register, means responsive to the occurrence of both a serial data pulse and a beat signal for loading a bit into said shift register, and means for clocking bits through said shift register in synchronism with the clocking of said serial data pulses, said lines being connected as outputs from selected stages of said shift register.

5. An instrument as claimed in claim 3 wherein said means for generating an instruction signal generates at least one additional instruction signal having a predetermined pattern different from that of said instruction signal; and wherein said additional instruction signal is connected as an additional enabling input to at least one of said gating means.

6. An instrument as claimed in claim 5 wherein there are at least three of said separate lines; and wherein said means for generating instruction signals generates three instruction signals each having a predetermined pattern different from that of the other instruction signals;

and wherein a first of said instruction signals is applied to said converting means, a second of said instruction signals is applied as an additional enabling input to the gating means for one of said lines; and including means for applying the third instruction signal as an additional enabling input to the gating means for a second of said lines, the gating means for the third of said lines having only a manual enabling input.

7. An instrument as claimed in claim 6 including means for manually applying a continuous signal level to the additional input of the gating means for said first and second lines, whereby the control of said second and third instruction signals respectively is overridden, leaving the associated gating means responsive only to said manually operable controls.

8. An instrument as claimed in claim 1 including manually operable means for causing said instruction signal to be a continuous signal level, whereby said converting means is caused to be operative in response to all serial data pulses applied thereto.

9. An electronic musical instrument having means for generating tone signals in a plurality of different pitches, and means for producing a predetermined repetitive signal pattern; characterized by:

an encoding device adapted to convert each signal of said repetitive pattern into a selected plurality of serial data pulses on a single output line therefrom;

said encoding device including means for converting each signal of said repetitive pattern into a plurality of pulses spaced at predetermined time intervals from each other, and means, including manually operable controls, for gating selected ones of said pulses to said single output line;

and decoder means connected to receive said serial data pulses and to control said generating means in response thereto to simultaneously generate a selected plurality of pitches;

whereby selected multiple pitches are simultaneously generated for each signal of said repetitive pattern.

* * * * *